US009075337B2

(12) United States Patent
Watanabe et al.

(10) Patent No.: US 9,075,337 B2
(45) Date of Patent: Jul. 7, 2015

(54) IMAGE FORMING APPARATUS AND METHOD USING ELECTROPHOTOGRAPHIC TWO-COMPONENT DEVELOPMENT

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Takeshi Watanabe, Kanagawa-ken (JP); Daisuke Ishikawa, Kanagawa-ken (JP); Shoko Shimmura, Kanagawa-ken (JP)

(73) Assignees: Kabushiki Kaisha Toshiba, Tokyo (JP); Toshiba Tec Kabushiki Kiasha, Tokyo (JP)

( * ) Notice: Subject to any disclaimer, the term of this patent is extended or adjusted under 35 U.S.C. 154(b) by 60 days.

(21) Appl. No.: 13/850,456

(22) Filed: Mar. 26, 2013

(65) Prior Publication Data

US 2013/0259538 A1 Oct. 3, 2013

Related U.S. Application Data

(60) Provisional application No. 61/619,508, filed on Apr. 3, 2012.

(30) Foreign Application Priority Data

Jan. 31, 2013 (JP) ..... 2013-016886

(51) Int. Cl.
*G03G 15/08* (2006.01)
*G03G 15/09* (2006.01)
*G03G 15/04* (2006.01)

(52) U.S. Cl.
CPC .... *G03G 15/04027* (2013.01); *G03G 15/04054* (2013.01); *G03G 2215/0132* (2013.01)

(58) Field of Classification Search
CPC ..... G03G 15/04027; G03G 15/09; G03G 15/0907; G03G 15/065; G03G 2215/0607; G03G 2215/0609; G03G 2215/0409
USPC ..... 399/270, 53, 55, 285
See application file for complete search history.

(56) References Cited

U.S. PATENT DOCUMENTS 5,424,811 A * 6/1995 Haneda ..... 399/270
2002/0122673 A1* 9/2002 Sakai et al. ..... 399/55 X (Continued)

FOREIGN PATENT DOCUMENTS

JP 04-158373 6/1992
JP 06-234239 8/1994

(Continued)

OTHER PUBLICATIONS

Japanese Office Action for Japanese Patent Application No. 2013-016886 mailed on Aug. 5, 2014.

*Primary Examiner* — Sophia S Chen
(74) *Attorney, Agent, or Firm* — Amin, Turocy & Watson, LLP

(57) ABSTRACT

According to one embodiment, an image forming apparatus includes an image bearing member on which an electrostatic latent image is formed by exposure, an exposing device including a plurality of light sources and a plurality of lenses, which are provided along a longitudinal direction of the image bearing member, and configured to radiate light on the image bearing member, and a developing device arranged at a fixed distance apart from the image bearing member and configured to develop, according to application of a direct-current bias, the electrostatic latent image formed on the image bearing member into a visible image using a two-component developer.

10 Claims, 9 Drawing Sheets

(56) References Cited

U.S. PATENT DOCUMENTS

| | | | | |
|---|---|---|---|---|
| 2008/0003003 | A1 | 1/2008 | Watanabe et al. | |
| 2008/0101808 | A1* | 5/2008 | Shih et al. | 399/55 X |
| 2008/0166143 | A1 | 7/2008 | Watanabe et al. | |
| 2009/0047046 | A1* | 2/2009 | Azami | 399/270 |
| 2011/0097117 | A1* | 4/2011 | Akita et al. | 399/270 |
| 2011/0142466 | A1* | 6/2011 | Willard et al. | 399/55 |
| 2012/0027450 | A1* | 2/2012 | Imai | 399/98 |

FOREIGN PATENT DOCUMENTS

| | | |
|---|---|---|
| JP | 2002-029093 | 1/2002 |
| JP | 2008-009421 | 1/2008 |
| JP | 2008-170955 | 7/2008 |

* cited by examiner

IMAGE FORMING APPARATUS AND METHOD USING ELECTROPHOTOGRAPHIC TWO-COMPONENT DEVELOPMENT

CROSS-REFERENCE TO RELATED APPLICATION

This application is based upon and claims the benefit of priority from: U.S. provisional application 61/619,508 filed on Apr. 3, 2012; and JP application No. 2013-016886, filed on Jan. 31, 2013; the entire contents of each of which are incorporated herein by reference.

FIELD

Embodiments described herein relate generally to an image forming apparatus.

BACKGROUND

In recent years, a small electronic device represented by an LED attracts attention as an exposing device in an electrophotographic apparatus.

Although an LED or an OLED is small in size, the LED or the OLED includes an extraordinarily large number of light-emitting points compared with a laser optical system and the like. Moreover, since a Selfoc (registered trademark) lens array is used, the LED or the OLED include a large number of lenses. As a result, fluctuation in optical characteristics occurs in a main scanning direction. Because of fluctuation in the characteristics of the light-emitting points and the characteristics of the Selfoc lenses, respective beam profiles are different. Therefore, when a halftone image is printed, streak-like density unevenness (vertical steaks or streak unevenness) occurs.

In order to reduce the density unevenness in the halftone image, in general, correction processing called beam diameter correction is performed on the side of an exposing device such as an LED. However, the beam diameter correction has the opposite effect if conditions change. Therefore, for example, there is proposed a method of changing the intensity of dot diameter correction and performing the dot diameter correction that is stable against environmental changes and the like.

Even if such a method is adopted, in the dot diameter correction, in particular, if the distance between an LED and a photoconductive member deviates from a focal position, the distance may be unable to be adjusted to the focal position. Because of the characteristics of the Selfoc lens array, the focal distance is as very small as about several ten micrometers. Therefore, even if fluctuation in the distance between the LED and the photoconductive member is slight, the fluctuation affects beam profiles. To make the matter worse, since the characteristics of the respective light-emitting points are disordered, the effect of the dot diameter correction may be unable to be obtained.

The related art is disclosed in, for example, Japanese Patent No. 3214124.

DETAILED DESCRIPTION

It is an object of the present invention to provide an image forming apparatus capable of forming a halftone image with reduced streak unevenness.

In general, according to one embodiment, an image forming apparatus includes: an image bearing member on which an electrostatic latent image is formed by exposure; an exposing device including a plurality of light sources and a plurality of lenses, which are provided along a longitudinal direction of the image bearing member, and configured to radiate light on the image bearing member; and a developing device arranged at a fixed distance apart from the image bearing member and configured to develop, according to application of a direct-current bias, the electrostatic latent image formed on the image bearing member into a visible image using a two-component developer.

An embodiment is specifically explained below.

Electrophotographic two-component development is gentle in a development characteristic (gamma) and is stable against fluctuation in an environment and the like compared with one-component development. In particular, when development is performed with a direct-current electric field, if there is a fixed distance between a developing roller and a photoconductive drum, development of microdots is facilitated by an edge effect of the electric field. As a result, reproducibility of isolated dots and the like is improved and microdots are highlighted and developed on the photoconductive drum larger than those in an electrostatic latent image.

If a solid-state exposing device such as an LED is used for exposure, in a halftone image, streak unevenness is caused by fluctuation in a beam diameter. A main cause of the streak unevenness is non-uniform microdots and thin lines. The two-component development applied with the direct-current electric field is combined with the solid-state exposing device such as the LED, whereby it is possible to reduce streak unevenness in the halftone image even if slight fluctuation occurs in a beam diameter.

The influence of the beam diameter fluctuation on the development can be reduced by adjusting optical energy radiated on the photoconductive drum functioning as an image beaming member to a fixed range. In this embodiment, it is desirable to set exposure energy to a value equal to or larger than a half and equal to or smaller than a double of a half decay exposure amount of the photoconductive drum. Consequently, it is possible to further reduce the streak unevenness that occurs in the halftone image.

If the exposure energy is set in this range under normal conditions, reproducibility of microdots and thin lines is deteriorated and line drawing reproducibility is deteriorated. However, it is possible to attain satisfactory line drawing reproducibility by combining the two-component development by the direct-current electric field with the solid-state exposing device.

Figure 1:
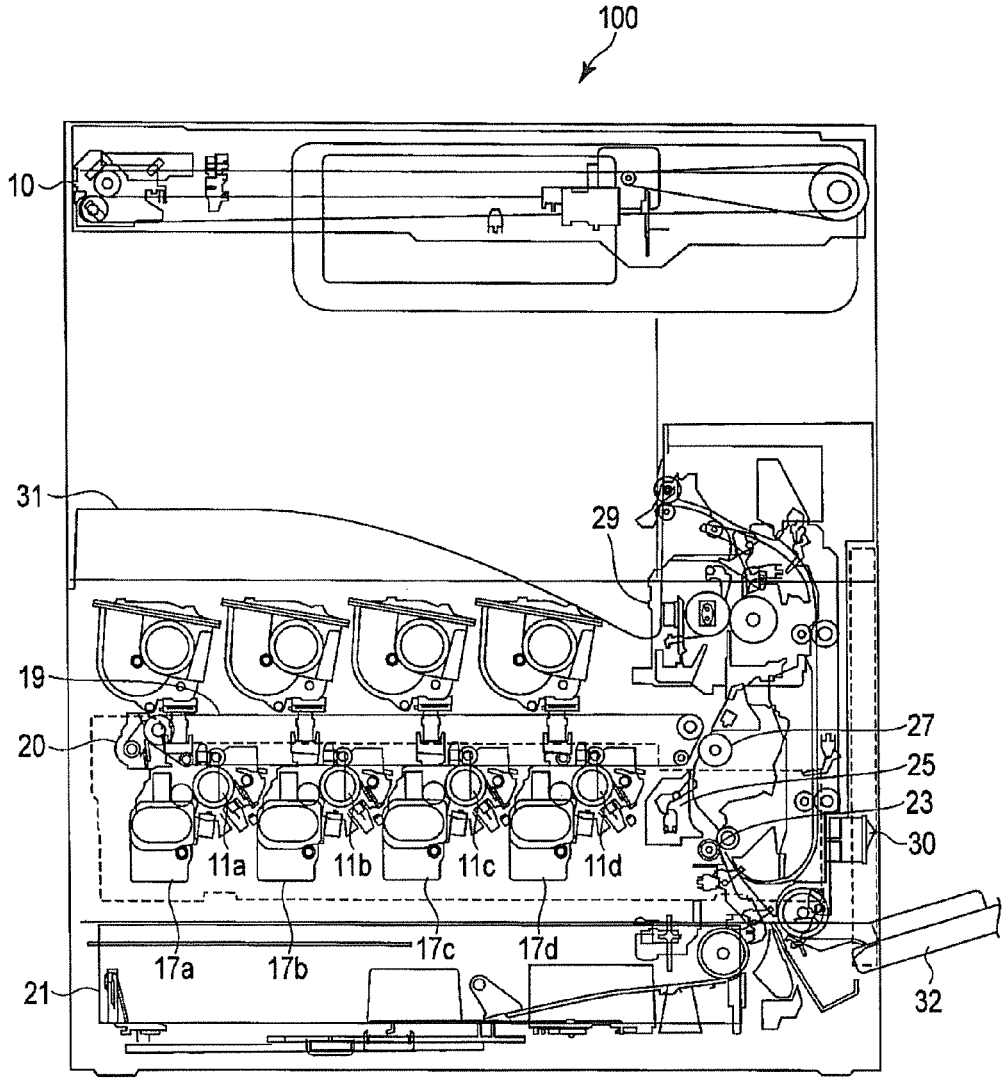
FIG. 1 is a diagram showing a front side cross section of an image forming apparatus according to an embodiment.

In FIG. 1, the configuration on the front side in an image forming apparatus according to the embodiment is shown.

An image forming apparatus 100 shown in the figure includes first to fourth photoconductive drums 11*a* to 11*d* functioning as image bearing members configured to bear electrostatic latent images, first to fourth developing devices 17*a* to 17*d* configured to supply developers to the electrostatic latent images born by the photoconductive drums 11*a* to 11*d* and form developer images, a transfer belt 19 configured to bear, in order, the developer images born by the photoconductive drums 11*a* to 11*d*, a cleaner 20 configured to remove the developers remaining on the transfer belt 19, a secondary transfer roller 27 configured to transfer the developer images born by the transfer belt 19 onto plain paper or a sheet, which is a transparent resin sheet such as an OHP sheet, a fixing device 29 configured to fix, on the sheet, the developer images transferred onto the sheet by the secondary transfer roller 27, and an exposing device configured to form latent images on the photoconductive drums 11*a* to 11*d*. The exposing device is explained in detail below.

Reference numeral 10 denotes a scanner unit configured to read an original document and 30 denotes a main power switch.

The first to fourth developing devices 17*a* to 17*d* store developers of arbitrary colors Y (yellow), M (magenta), C (cyan), and Bk (black) used for obtaining a color image through subtractive color mixing. The first to fourth developing devices 17*a* to 17*d* visualize the latent images respectively born by the photoconductive drums 11*a* to 11*d* with any one of the colors Y, M, C, and Bk. The order of the colors is determined as predetermined order according to an image forming process and characteristics of the developers.

The transfer belt 19 bears, in the order of the formation of the developer images, the developer images of the respective colors formed by the first to fourth photoconductive drums 11*a* to 11*d* and the developing devices 17*a* to 17*d* corresponding thereto and transfers the developer images onto plain paper or a sheet, which is a transparent resin sheet such as an OHP sheet.

A paper feeding cassette 21 stores sheets of an arbitrary size. A pickup roller (not shown in the figure) picks up a sheet from the cassette according to an image forming operation. The size of the sheet corresponds to magnification requested in image formation and the size of developer images to be formed.

A registration roller 23 and an image-quality maintenance control unit 25 send, according to timing when the secondary transfer roller 27 transfers the developer images from the transfer belt 19, the picked-up sheet to a transfer position where the secondary transfer roller 27 and the transfer belt 19 are in contact with each other.

It is also possible to supply sheets from a manual feed tray 32 and form developer images on a desired sheet according to necessity.

The sheet having the developer images transferred thereon by the secondary transfer roller 27 is discharged to a paper discharge tray 31 after the developer images are fixed on the sheet by the fixing device 29.

Figure 2:
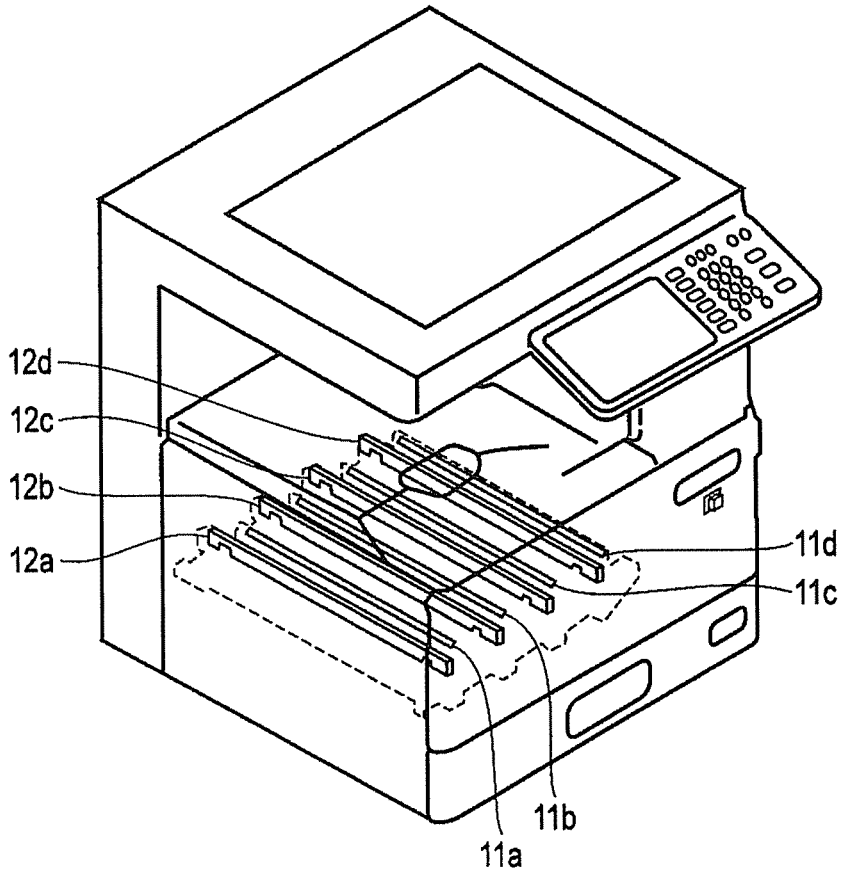
FIG. 2 is a transparent perspective view showing a writing section in the image forming apparatus.
Figure 3:
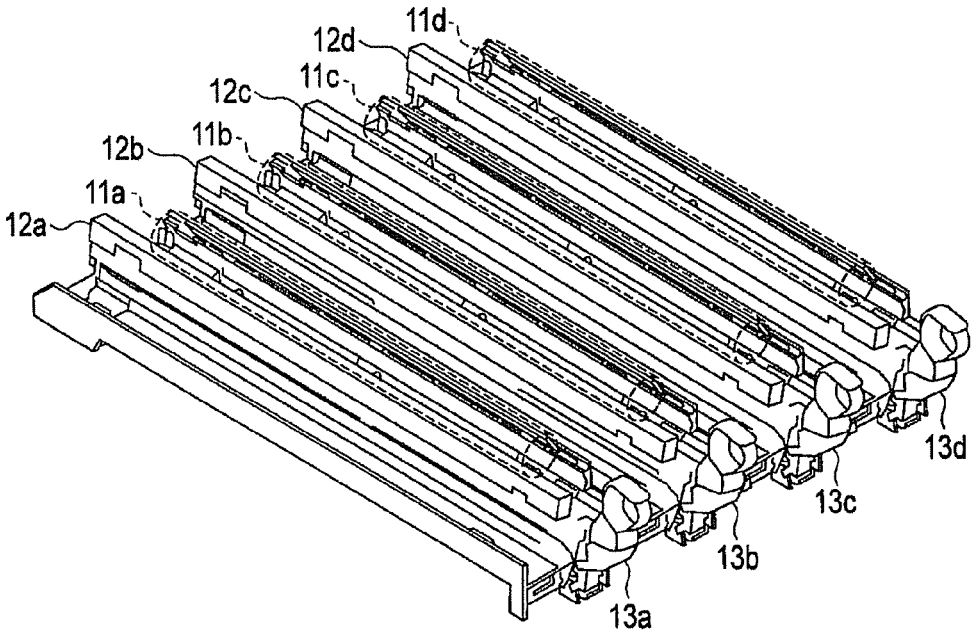
FIG. 3 is a schematic diagram showing the configuration of the writing section.

In FIG. 2, a transparent perspective view of a writing section in the image forming apparatus is shown. As shown in the figure, LED print heads 12*a* to 12*d* are respectively arranged near the first to fourth photoconductive drums 11*a* to 11*d*. The photoconductive drums 11*a* to 11*d* are formed in a shape having a longitudinal direction. The LED print heads 12*a* to 12*d* are arranged along the longitudinal direction. As shown in FIG. 3, LED print head contact and separation levers 13*a* to 13*d* are respectively provided in pairs including the photoconductive drums 11*a* to 11*d* and the LED print heads 12*a* to 12*d*.

The writing section plays a role of performing LED light irradiation on the photoconductive drums 11*a* to 11*d* on the basis of a digital image signal sent from a scanner, a USB, a network, or the like and forming electrostatic latent images on the photoconductive drums 11*a* to 11*d*. The LED lights based on the image signals are respectively radiated on the photoconductive drums 11*a* to 11*d* by the LED print heads 12*a* to 12*d*.

Figure 4:
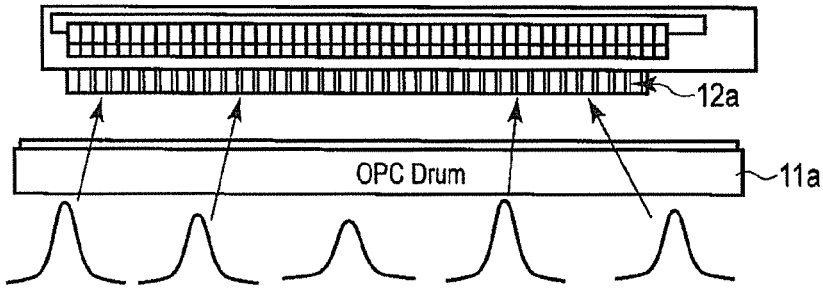
FIG. 4 is a schematic diagram showing the configuration in the longitudinal direction of an LED printer head.

In FIG. 4, an overview of the configuration in the longitudinal direction of the LED print head 12*a* and a part of beam profiles are shown. As shown in FIG. 4, the LED print head 12*a* has a shape extending in the longitudinal direction of the photoconductive drum 11*a* and includes a plurality of light sources and a plurality of lenses. Since the LED print head 12*a* includes a large number of light-emitting points and lenses, beam profiles of light radiated from the LED print head 12*a* are not always uniform. As shown in the figure, fluctuation occurs in the beam profiles and degrees of the fluctuation are different from one another.

Figure 5:
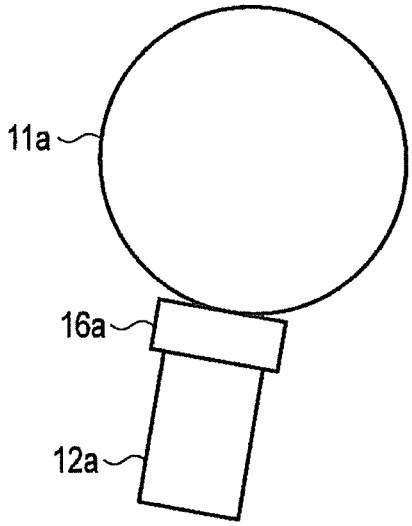
FIG. 5 is a schematic diagram showing a photoconductive drum and the LED printer head.

As shown in FIG. 5, the photoconductive drum 11*a* and the LED print head 12*a* are arranged via a gap spacer 16*a*, whereby a space between the photoconductive drum 11*a* and the LED print head 12*a* is kept at a fixed space. The gap spacer 16*a* is a component that is periodically replaced taking into account a shift of a gap due to abrasion.

Figure 6:
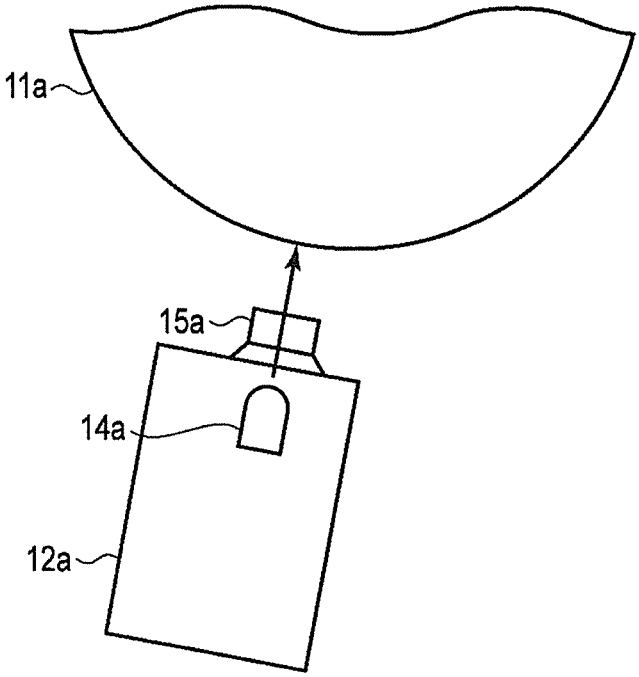
FIG. 6 is an enlarged view of the LED printer head.

As shown in an enlarged view of FIG. 6, the LED print head 12*a* includes an LED (light-emitting diode) 14*a* functioning as a light source. LED light is radiated on the photoconductive drum 11*a* through a lens 15*a*. The depth of focus of the lens 15*a* and the photoconductive drum 11*a* is considered to be about ±15 μm.

An electrostatic latent image formed on the surface of the photoconductive drum 11*a* by the radiation of the LED light is developed with a developer supplied from a developing device.

Figure 7:
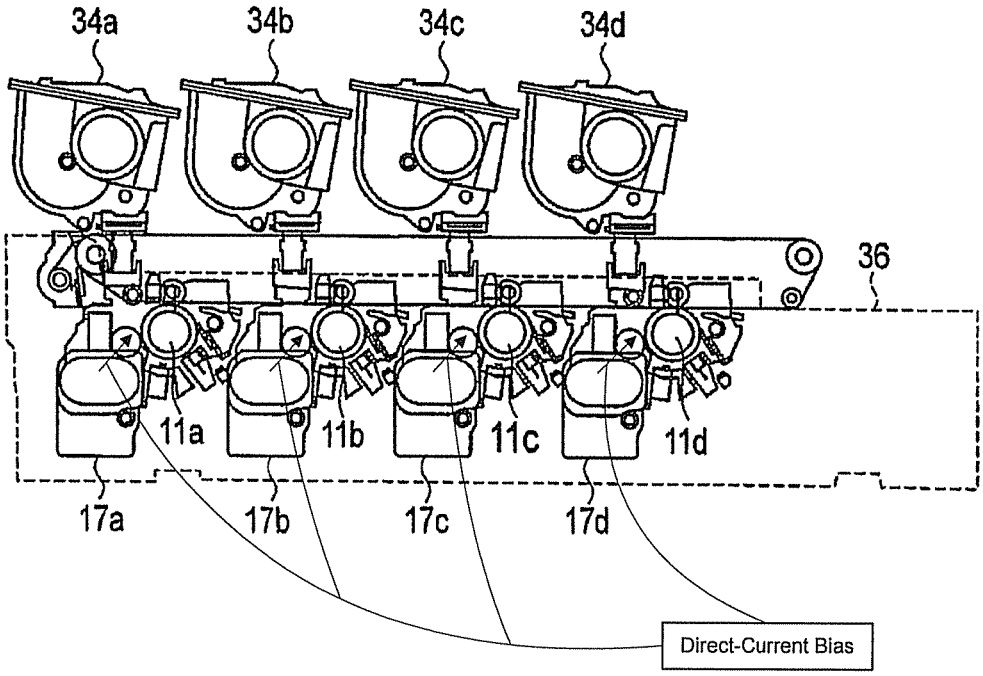
FIG. 7 is a schematic diagram showing the configuration of the vicinity of a developing device.

As shown in FIG. 7, developers are supplied to the developing devices 17*a* to 17*d* respectively from developer supplying devices 34*a* to 34*d*. In this embodiment, a two-component developer containing toner particles and carrier particles is used. As an available two-component developer, for example, a two-component developer obtained by mixing, at a weight ratio of 3 to 20%, a toner having a particle diameter of 4 to 12 μm including an externally added agent formed by polyester or acrylic resin, silica, and the like having a particle diameter of 4 to 10 μm in a ferrite carrier having a particle diameter of 30 to 60 μm coated with silicone or acrylic resin on the surface is used. The toner may be manufactured by either a grinding method or a polymerization method. The carrier can be a form in which a magnetic body is dispersed in resin rather than having a ferrite core.

The developers are agitated in the developing devices 17*a* to 17*d*. The toner particles are charged in minus polarity and the carrier particles are charged in plus polarity by the friction of the agitation. The charged toner particles are supplied to the surfaces of the photoconductive drums 11*a* to 11*d* by a magnet roller (not shown in the figure). The charged toner particles adhere to portions where the potential of the photoconductive drums is low with respect to a development bias applied to the magnet roller. In this embodiment, a direct-current electric field is applied as the development bias.

According to such a process, images are formed on the surfaces of the photoconductive drums 11*a* to 11*d*. The developers not used for the image formation are collected in a waste developer box 36.

Figure 8:
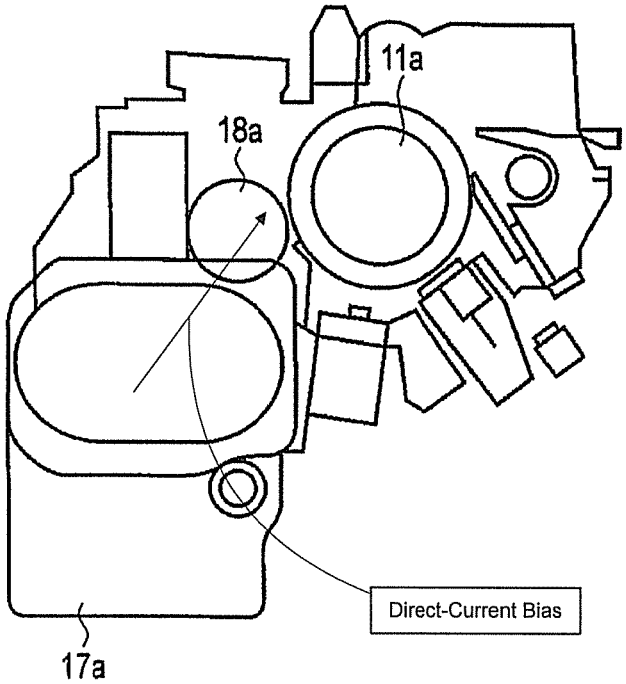
FIG. 8 is an enlarged view of the developing device and the photoconductive drum.

As shown in FIG. 8, the developing device 17*a* includes a developing roller 18*a* arranged to be opposed to the photoconductive drum 11*a*. The developer is supplied to the surface of the photoconductive drum 11*a* by the developing roller 18*a*, whereby the electrostatic latent image formed on the surface of the photoconductive drum 11*a* is developed (visualized).

In this embodiment, the developing roller 18*a* is arranged at a fixed distance from the photoconductive drum 11*a*. The distance between the developing roller 18*a* and the photoconductive drum 11*a* is desirably 0.15 mm to 0.55 mm. "The distance between a developing roller and a photoconductive drum" is synonymous with "the distance between developing means and an image bearing member".

As explained above, fluctuation occurs in beam diameters because the LED print head includes a large number of light-emitting points and lenses. Dot diameters obtained after development also fluctuate. As a result, a halftone image with reduced streak unevenness may be unable to be obtained. In order to obtain the halftone image with reduced streak unevenness, the fluctuating beam diameters have to be corrected to be uniform. A conceptual diagram of the beam diameter correction is shown in FIGS. 9A and 9B.

Figure 9A:
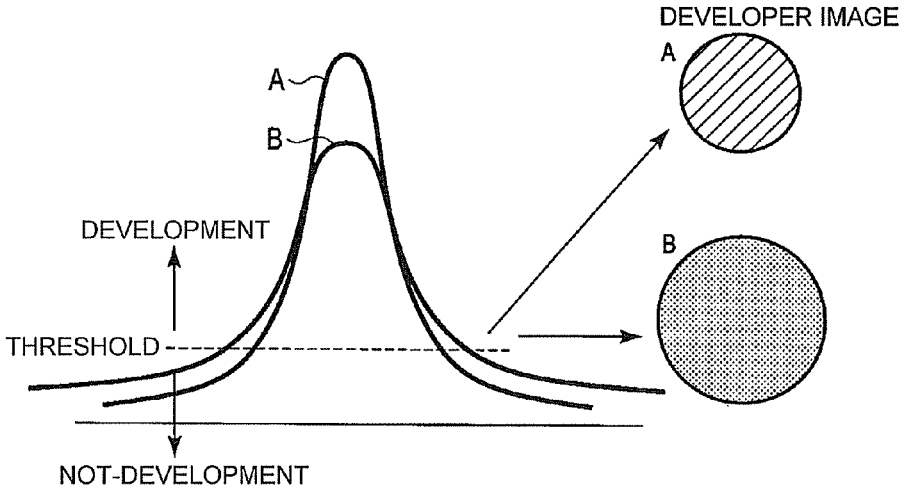
FIGS. 9A and 9B are conceptual diagrams of beam diameter correction.
Figure 9B:
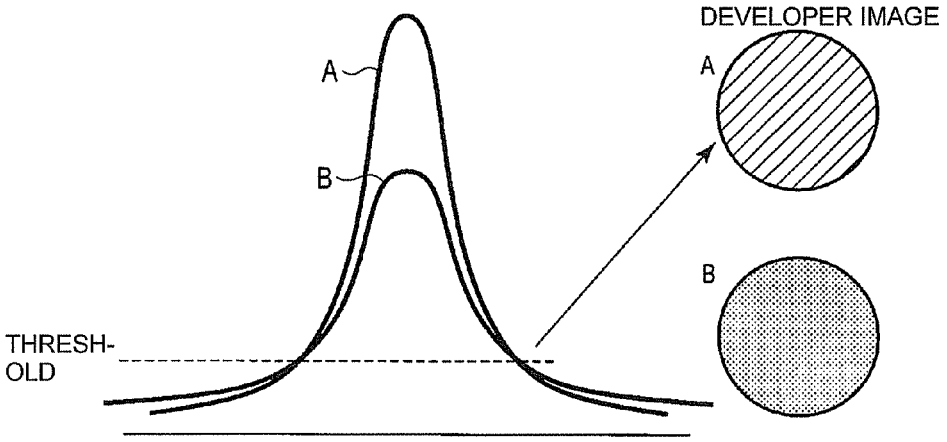

As shown in FIG. 9A, it is assumed that beam profiles of types represented by profiles A and B are present. Since the profile A is further narrowed down than the profile B, a developer image A is smaller than a developer image B. To obtain the same dot diameters at a development threshold as shown in FIG. 9B, dot correction is performed by increasing a light amount of the profile A further narrowed down than the profile B.

Usually, correction processing based on a current value or the like corresponding to beam profiles is applied to the respective light-emitting points of the LED print head. Therefore, if the correction processing is optimally performed and uniform dot diameters are maintained, streak unevenness does not occur in the halftone image.

However, as explained above, the depth of focus of the LED print head (the lenses) and the photoconductive drum is considered to be about ±15 μm. If the depth of focus fluctuates, the beam profiles also fluctuate. When costs and durability of the device are taken into account, it is difficult to adjust the positions of the photoconductive drum and the LED print head such that the depth of focus can be always surely maintained in a predetermined range.

As it is seen from FIG. 9A, if the development threshold is present near the skirts of the beam profiles, fluctuation in the dot diameters at the development threshold increases when the profiles fluctuate. In regions where exposure energy is higher, portions where the two beam profiles overlap each other are present. Therefore, if the development threshold can be set in positions where the exposure energy is higher (e.g., the centers of the beam profiles), it is expected that the influence on the dot diameters is small even if the beam profiles fluctuate.

Figure 10A:
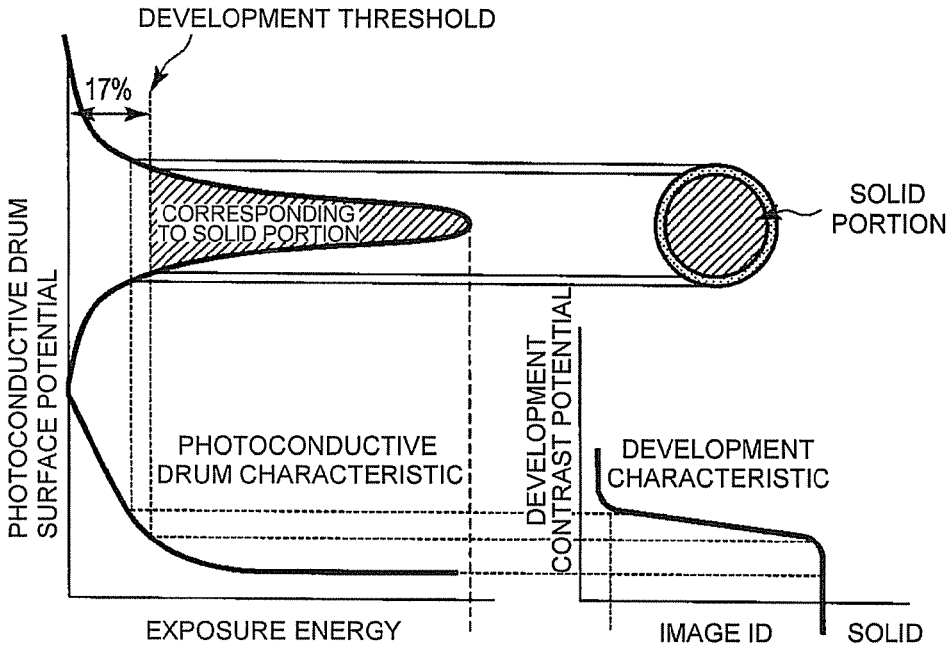
FIGS. 10A and 10B are schematic diagrams showing a relation between an exposure profile and a reproduced dot and a photoconductive drum characteristic and a development characteristic.
Figure 10B:
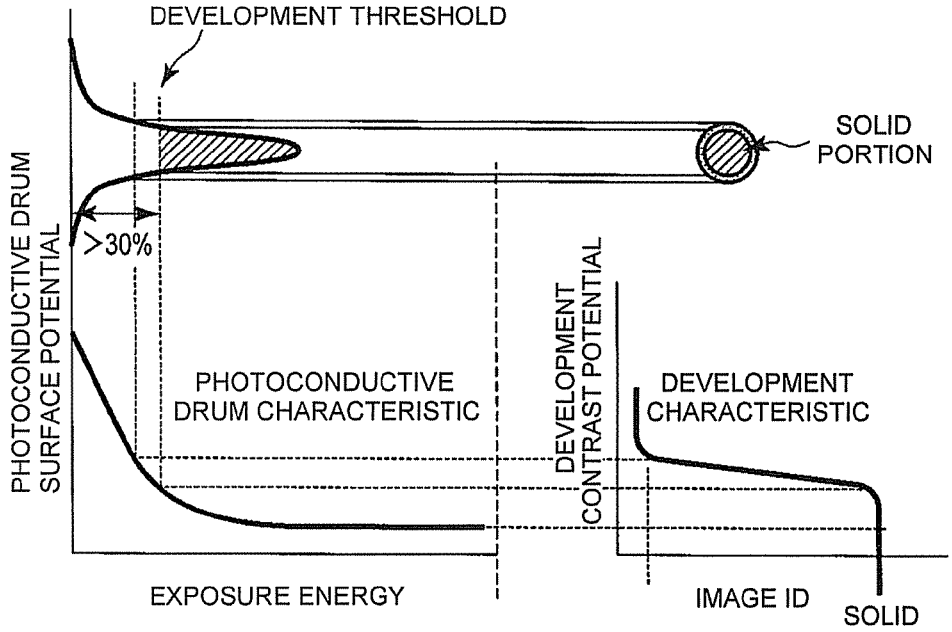

In FIGS. 10A and 10B, a relation between light amount setting (an exposure profile) and a reproduced dot and a photoconductive drum characteristic and a development characteristic is schematically shown. The photoconductive drum characteristic is represented by a change in photoconductive drum surface potential with respect to a change in exposure energy. The development characteristic is represented by a change in development contrast potential with respect to a change in an image ID. The size of a painted-out region in a beam profile is equivalent to the size of a solid portion.

In FIG. 10A, the development threshold is 17% and is set to a predetermined light amount. FIG. 10B shows a result obtained by performing development under the same conditions except that the light amount is set low. In FIG. 10B, the development threshold is 30%. It is seen from this result that, by setting the light amount low, the development threshold shown on the beam profile shifts to the center portion of the beam profile.

Figure 11:
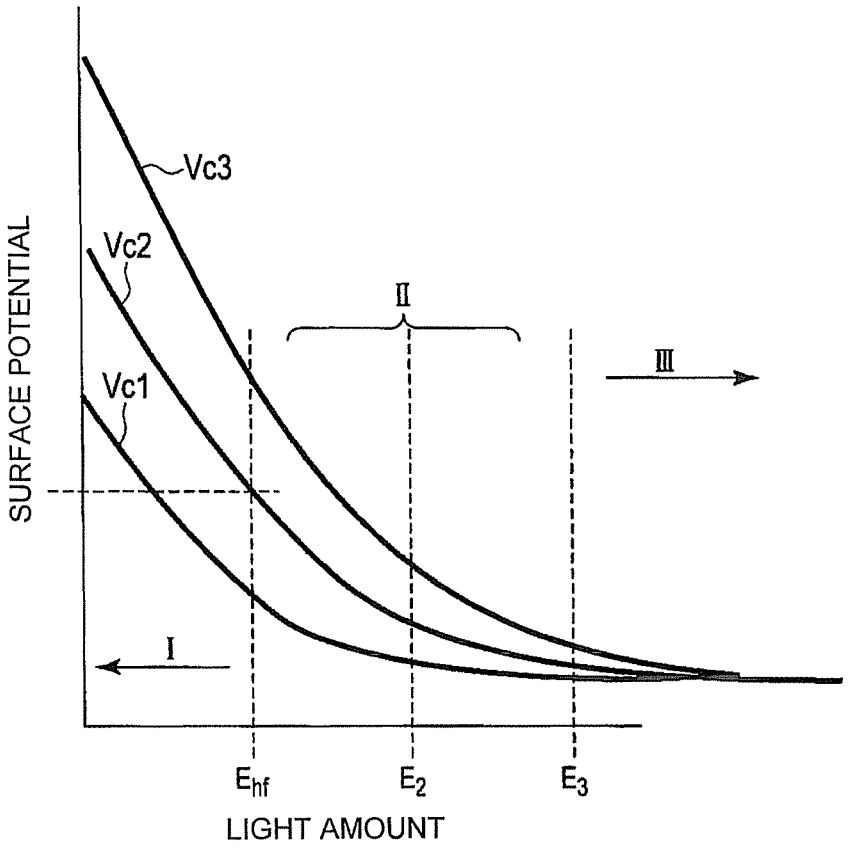
FIG. 11 is a graph showing a relation between an exposure light amount and surface potential.

A relation between a light amount and surface potential is explained with reference to FIG. 11.

In the figure, $E_{hf}$ on the abscissa represents a half decay light amount and E2 and E3 respectively represent double and triple light amounts of the half decay light amount. In FIGS. 10A and 10B, a relation between an exposure light amount and surface potential is shown concerning three different kinds of deposition suppression potential Vc represented by curves Vc1, Vc2, and Vc3.

As indicated by I, in a region of a light amount smaller than the half decay light amount ($E_{hf}$), even if the deposition suppression potential Vc fluctuates from Vc1 to Vc3 and charging potential changes, a ratio of a change of photoconductive drum potential to light amount fluctuation does not substantially change. That is, the gradients of the three curves Vc1, Vc2, and Vc3 do not substantially change.

In a region of about the double light amount (E2) of the half decay light amount indicated by II, if the deposition suppression potential Vc fluctuates from Vc1 to Vc3 and changing potential changes, the ratio of the change in photoconductive potential is large. That is, the change in the gradients of the three curves is large.

As indicated by III, in a region where a light amount exceeds the triple light amount (E3) of the half decay light amount, even if the deposition suppression potential Vc changes from Vc1 to Vc3 and the charging potential changes, the ratio of the change in photoconductive potential with respect to the light amount fluctuation does not substantially change. That is, since the potential drops to the bottom, the change in the gradients of the three curves is small.

It is seen on the basis of such a result that light amount energy of the exposing device is desirably smaller than a double of the half decay exposure amount. If stability and reproducibility of the potential of the photoconductive drum are taken into account, the light amount energy of the exposing device is desirably equal to or larger than a half of the half decay exposure amount.

LED exposure and two-component development were combined to form dots and the sizes of obtained dot diameters were checked. As the exposing device, a 600 dpi exposing device manufactured by Oki Digital Imaging Corporation was used. Exposure energy of an LED was set to 4 nJ/nm$^2$. Dot correction processing was applied to the LED in advance.

The two-component developer used for the dot formation includes a carrier obtained by coating ferrite manufactured by Powdertech Co., Ltd. with silicone and a polyester toner.

First, only a direct-current bias (−300 v) was applied. The distance between the photoconductive drum and the developing roller was changed between 0.05 mm and 0.7 mm and dots were formed on the photoconductive drum. A focal position of the LED was shifted by about −15 μm and dot diameter correction was carried out in a slightly disordered state. The shift of the focal position of this degree usually occurs because of a component tolerance or the like. In an initial state, fluctuation of this degree is a condition that is sufficiently conceivable. An electrostatic latent image was developed by the two-component developer and a test result of microdot reproduction was checked.

Specifically, reproducibility of 1 dot (an ideal diameter of which is 42.3 μm) at 600 dpi was checked. A half decay exposure amount of the photoconductive drum is 1.5 nJ/nm$^2$ and exposure energy of the photoconductive drum is 4 nJ/nm$^2$. The diameters of one hundred isolated dots among isolated dots formed on the photoconductive drum were photographed by a CCD camera and thereafter measured by ImagePro. Maximum values and minimum values of the diameters are tabulated in Table 1 below.

Figure 12:
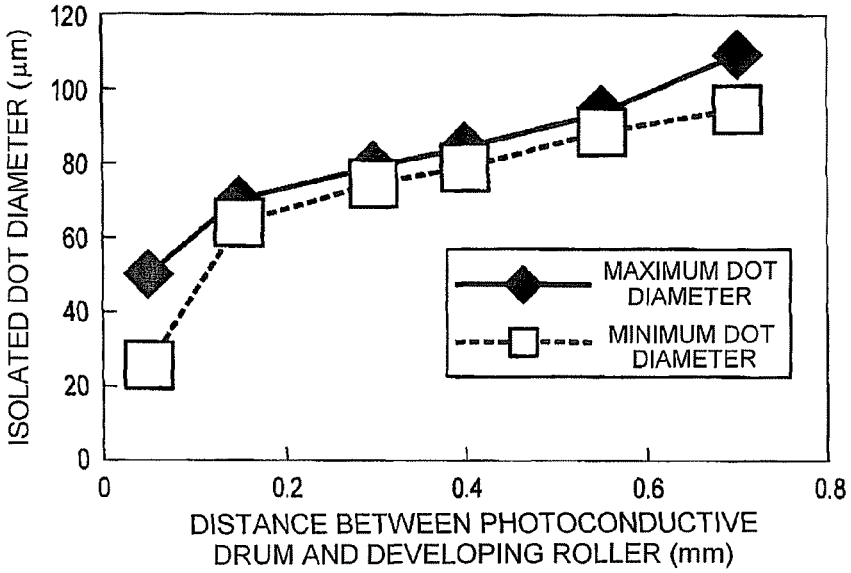
FIG. 12 is a graph showing a relation between the distance between a photoconductive drum and a developing roller and an isolated dot diameter.

In Table 1, streaks in a halftone image are also described. The halftone image was evaluated by forming gradation images of thirty-two gradations and mainly determining image quality of a streak level. If streak unevenness was not visually found, the image quality was evaluated as "A". If streak unevenness was found, the image quality was evaluated as "B". Maximum dot diameters and minimum dot diameters are shown in a graph of FIG. 12 as well.

TABLE 1

| | Maximum dot diameter (μm) | Minimum dot diameter (μm) | Halftone streak |
|---|---|---|---|
| 0.05 | 50 | 25 | B |
| 0.15 | 70 | 65 | A |
| 0.3 | 80 | 75 | A |
| 0.4 | 85 | 80 | A |
| 0.55 | 95 | 90 | A |
| 0.7 | 110 | 95 | deformed and dirty |

Figure 13:
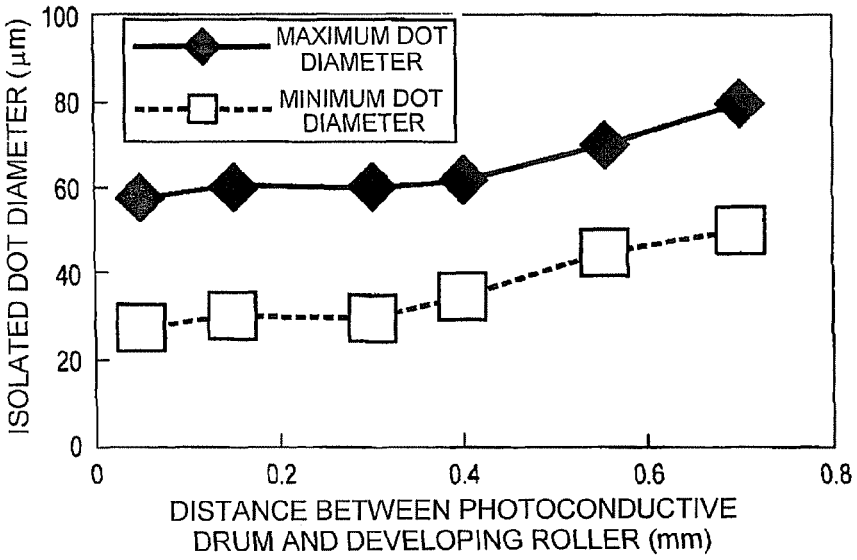
FIG. 13 is a graph showing a relation between the distance between the photoconductive drum and the developing roller and the isolated dot diameter.

A test was performed and reproducibility of microdots was checked under conditions same as the above except that an alternating-current bias (pp 5 kV and 1 kHz) was superimposed. Results concerning maximum dot diameters, minimum dot diameters, and halftone streaks are tabulated in Table 2 below. The maximum dot diameters and the minimum dot diameters are shown in a graph of FIG. 13 as well.

TABLE 2

| | Maximum dot diameter (μm) | Minimum dot diameter (μm) | Halftone streak |
|---|---|---|---|
| 0.05 | 57 | 27 | B |
| 0.15 | 60 | 30 | B |
| 0.3 | 60 | 30 | B |
| 0.4 | 62 | 35 | B |
| 0.55 | 70 | 45 | B |
| 0.7 | 80 | 90 | B |

It is seen from comparison of Table 1 and Table 2 that, if only the direct-current bias is applied, the dot diameters are reproduced larger than the dot diameters reproduced if the alternating-current bias is superimposed. Moreover, it is seen that, in this case, differences between the maximum dot diameters and the minimum dot diameters are small and dot diameters are extremely stable.

The dot diameters tend to be larger as the distance between the photoconductive drum and the developing roller increases. This is because, since a gap is large, an edge effect occurs in an electric field and dots are developed while being further highlighted than actual dots. In this case, the sizes of the beam diameters are not reproduced faithfully to the dot diameters. However, on the other hand, since the diameters of the microdots that tend to be unstable because of fluctuation in the beam diameters or the like are stabilized, the streak unevenness can be reduced.

If only the direct-current bias is applied, as shown in Table 1, no halftone streak is found if the distance between the photoconductive drum and the developing roller is within a range of 0.15 to 0.55 mm.

On the other hand, if the alternating-current bias is superimposed, a maximum difference between the maximum dot diameter and the minimum dot diameter reaches 30 mm. Moreover, the halftone streaks occur at any distance irrespective of the distance between the photoconductive drum and the developing roller.

From the above results, it was confirmed that a streak level is excellent on an image if only the direct-current bias with which the dots are stably reproduced is applied and the distance between the photoconductive drum and the developing roller is set within the range of 0.15 to 0.55 mm.

The light amount energy was changed to perform exposure and streak unevenness in an obtained halftone image was checked.

A photoconductive drum having a half decay exposure amount of 1.5 nJ/mm$^2$ was used and a light amount was changed to determine streak unevenness in a halftone image. As explained with reference to FIGS. 10A and 10B, if the light amount is set low, the development threshold shifts. Therefore, the fluctuation in the beam profiles should be further reduced.

As the shift of the focal position is larger, the fluctuation in the beam profiles increases. Therefore, a gap between the photoconductive drum and the LED was set to 30 μm and 50 μm, a halftone image was formed by a method same as the method explained above, and streak unevenness that occurred in the halftone image was evaluated. Results of the evaluation are tabulated in Table 3 below. In Table 3, "C" indicates that slight streak unevenness occurred.

TABLE 3

| Light amount | Halftone streak | | |
|---|---|---|---|
| (nJ/mm$^2$) | ±0 μm | −30 μm | −50 μm |
| 0.5 | A | C | B |
| 0.75 | A | A | A |
| 1 | A | A | A |
| 2 | A | A | A |
| 3 | A | A | A |
| 4 | A | C | B |

As shown in Table 3, if the light amount is within a range of 0.75 to 3 nJ/mm$^2$, a halftone streak is not found irrespective of the gap between the photoconductive drum and the LED. Since the half decay exposure amount of the photoconductive drum is 1.5 nJ/mm$^2$, such a range of the light amount corresponds to a half to a double of the half decay exposure amount.

It was confirmed that it is possible to further reduce the streak unevenness by setting the light amount energy to an amount equal to or larger than a half and equal to or smaller than a double of the half decay exposure amount of the photoconductive drum. By setting the exposing device under such conditions and used, even if a member and the like that determine the gap is shaved because of component accuracy, an environment, continuous use, or the like, it is expected that the occurrence of the streak unevenness in the halftone image is reduced.

According to at least one of the embodiments explained above, because an image forming apparatus includes an image bearing member, an exposing device including a plurality of light sources and a plurality of lenses, which are provided along a longitudinal direction of the image bearing member, and configured to radiate light on the image bearing member, and a developing device arranged at a fixed distance apart from the image bearing member and configured to develop, according to application of a direct-current bias, an electrostatic latent image formed on the image bearing member into a visible image using a two-component developer. Therefore, it is possible to form a halftone image with reduced streak unevenness.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image bearing member on which an electrostatic latent image is formed by exposure;

an exposing device including a plurality of light sources and a plurality of lenses, which are provided along a longitudinal direction of the image bearing member, and configured to radiate light on the image bearing member; and a developing device arranged at a fixed distance apart from the image bearing member and configured to develop, according to application of a direct-current bias, the electrostatic latent image formed on the image bearing member into a visible image using a two-component developer, wherein the image bearing member is a photoconductive member, and light amount energy of the exposing device is equal to or larger than a half and equal to or smaller than a double of a half decay exposure amount of the photoconductive member.

2. The apparatus according to claim 1, wherein the distance between the developing device and the image bearing member is equal to or larger than 0.15 mm and equal to or smaller than 0.55 mm.

3. The apparatus according to claim 1, wherein a pair of the exposing device and the image bearing member is provided with an exposing-device contact and separation lever.

4. The apparatus according to claim 1, wherein the exposing device and the image bearing member are arranged via a gap spacer.

5. The apparatus according to any one of claims 1, 2, 3, and 4, wherein each light source of the exposing device is an LED.

6. An image forming method comprising:

radiating light on an image bearing member to form an electrostatic latent image on the image bearing member by an exposing device including a plurality of light sources and a plurality of lenses, which are provided along a longitudinal direction of the image bearing member; and applying a direct-current bias to a two-component developer and developing the electrostatic latent image formed on the image bearing member into a visible image by using the two-component developer, wherein the image bearing member is a photoconductive member, and light amount energy of the exposing device is equal to or larger than a half and equal to or smaller than a double of a half decay exposure amount of the photoconductive member.

7. The image forming method according to claim 6, wherein the distance between the developing device and the image bearing member is equal to or larger than 0.15 mm and equal to or smaller than 0.55 mm.

8. The image forming method according to claim 6 or 7, wherein each light source of the exposing device is an LED.

9. The image forming method according to claim 6, wherein a pair of the exposing device and the image bearing member is provided with an exposing-device contact and separation lever.

10. The image forming method according to claim 6, wherein the exposing device and the image bearing member are arranged via a gap spacer.

* * * * *

UNITED STATES PATENT AND TRADEMARK OFFICE

CERTIFICATE OF CORRECTION

PATENT NO. : 9,075,337 B2
APPLICATION NO. : 13/850456
DATED : July 7, 2015
INVENTOR(S) : Takeshi Watanabe, Daisuke Ishikawa and Shoko Shimmura It is certified that error appears in the above-identified patent and that said Letters Patent is hereby corrected as shown below:

On the title page

Item (73) Assignees:

Kabushiki Kaisha Toshiba, Tokyo (JP);
Toshiba Tec Kabushiki Kiasha, Tokyo (JP)

It should read:

(73) Assignees:

Kabushiki Kaisha Toshiba, Tokyo (JP);
Toshiba Tec Kabushiki Kaisha, Tokyo (JP)

Signed and Sealed this
Fifteenth Day of December, 2015

Michelle K. Lee

Michelle K. Lee
*Director of the United States Patent and Trademark Office*